United States Patent [19]

Griffin

[11] 3,998,517

[45] Dec. 21, 1976

[54] MULTIPLE OUTLET ELECTRICAL CONNECTOR

[75] Inventor: Richard H. Griffin, Riverside, R.I.

[73] Assignee: International Telephone and Telegraph Corporation, Nutley, N.J.

[22] Filed: June 20, 1975

[21] Appl. No.: 588,758

[52] U.S. Cl. ..... 339/164 M; 339/20

[51] Int. Cl.[2] ..... H01R 13/50

[58] Field of Search ..... 339/19, 20, 28, 29, 339/154, 163, 164 R, 164 M, 198 S, 198 P, 256 SP, 258 S

[56] References Cited

UNITED STATES PATENTS

| | | | |
|---|---|---|---|
| 1,650,706 | 11/1927 | Gent | 339/198 S |
| 1,889,695 | 11/1932 | Peterson | 339/163 |
| 2,634,312 | 4/1953 | Batcheller | 339/258 S |
| 2,820,211 | 1/1958 | Batcheller | 339/258 S |
| 3,772,633 | 11/1973 | Danesi | 339/164 R |

*Primary Examiner*—Roy Lake
*Assistant Examiner*—Mark S. Bicks
*Attorney, Agent, or Firm*—John T. O'Halloran; Thomas M. Marshall

[57] ABSTRACT

A multiple outlet connector cordset provides a plurality of three-wire receptacles connected to a single three-wire electrical line. Two or three outlets having locking or straight contacts are connected in parallel. The wires from the outlets are connected through sliding detachable terminals to blades extending from a plurality of parallel longitudinal connecting strips or bus bars. The strips are mounted within a premold rectangular support and have additional blades on the opposite side which connect through further terminals to the input wires. The premold and terminals hold the elements in position for a final molding operation. The entire assembly of receptacles, contacts, and wires, terminals, strips and rectangular premold is molded into a single integral outer insulation cover.

4 Claims, 9 Drawing Figures

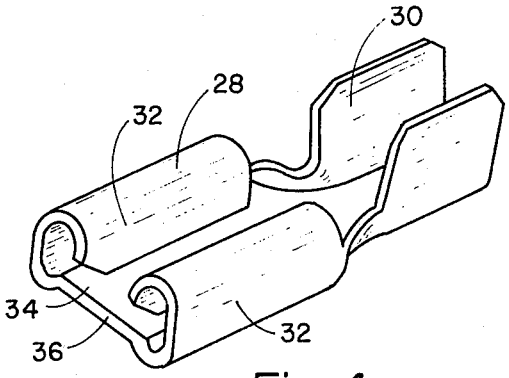
Fig. 4
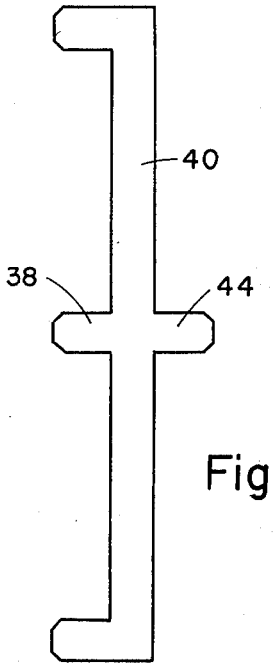
Fig. 6
Fig. 5a
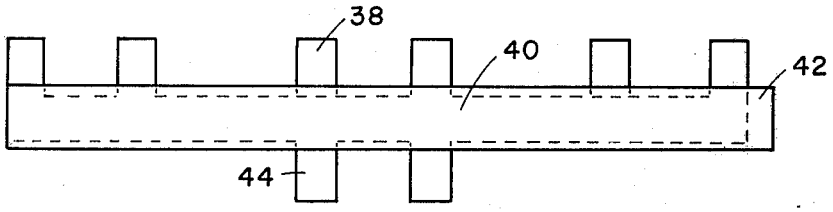
Fig. 5b
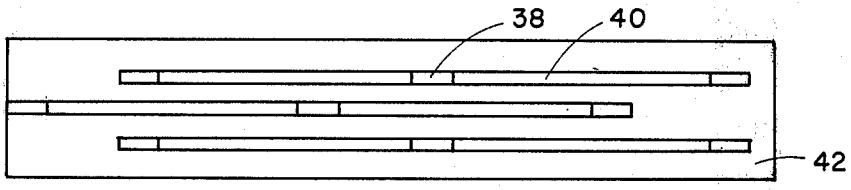
Fig. 5c
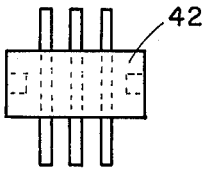

MULTIPLE OUTLET ELECTRICAL CONNECTOR

BACKGROUND OF THE INVENTION

1. Field of the Invention

The present invention relates to multiple electrical connectors and particularly to a simplified reliable connector assembly and premold which hold the elements in position for molding in an integral outer insulation cover.

2. Description of the Prior Art

Presently available multiple outlet electrical cordsets are formed of a plurality of separate three-wire receptacles molded at the ends of separate short lengths of insulated three-wire lines. The separate lines are spliced together at a common joint with one input three-wire line. The splices are generally formed by inserting the bare wires into the ends of an insulating sleeve and crushing the wires together. The multiple splice joint and adjacent ends of the insulated wire lines are then molded within a solid insulating block. The input line and plug extend from one side of the block while the separately molded receptacles are at the ends of two or three unsupported short lines extending from the opposite end of the block. This type of device is bulky and difficult to handle. In addition, the spliced wires may move during the molding operation and result in poor connections or short circuits.

SUMMARY OF THE INVENTION

It is therefore the primary object of the present invention to provide a reliable simplified multiple outlet connector cordset in which the elements are molded into a single integral unit.

This is accomplished by using a novel premold body which supports a plurality of longitudinal connector strips or bus bars with tabs or blades extending from opposite sides. A plurality of three-wire receptacles, including contacts and lead wires, are connected through sliding detachable terminals which engage the blades on one side of the strip, while a single three-wire input line and plug connects through like detachable terminals to blades on the opposite side. The premold and terminals provide secure connections during a final molding operation. The entire assembly, including premold, connector strips, terminals, receptacles, contacts and lead wires, is molded into an integral solid insulation body providing a multiple outlet. Other objects and advantages will become apparent from the following description in conjunction with the accompanying drawings.

BRIEF DESCRIPTION OF THE DRAWINGS

FIG. 4 is an isometric view of the slideable detachable terminal, FIGS. 5A, 5B and 5C show top, side and end views of the premold connector strip assembly, and FIG. 6 is a top view of a connector strip.

DESCRIPTION OF THE PREFERRED EMBODIMENT

Figure 1A:
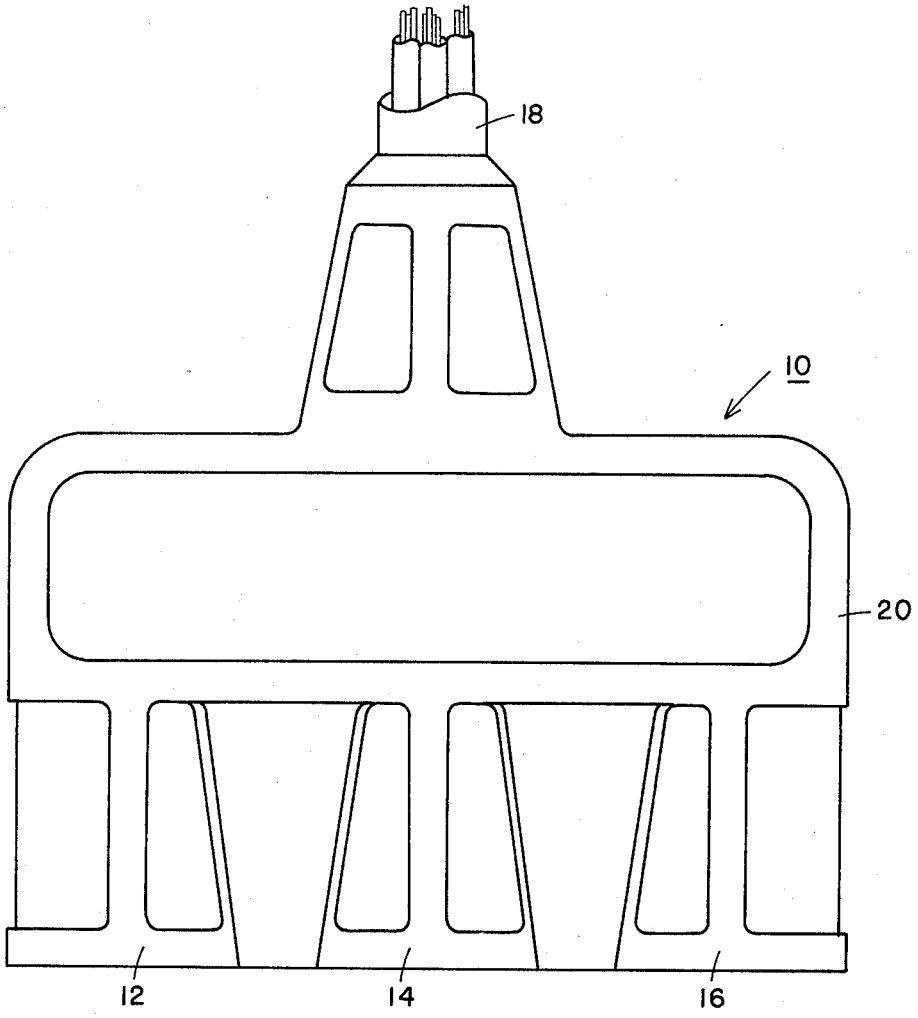
FIGS. 1A and 1B show top and end views of a multiple outlet connector having an integral molded structure.
Figure 1B:
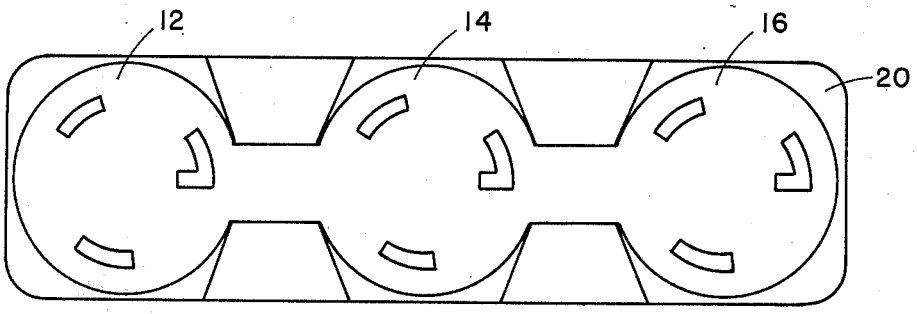
Figure 2:
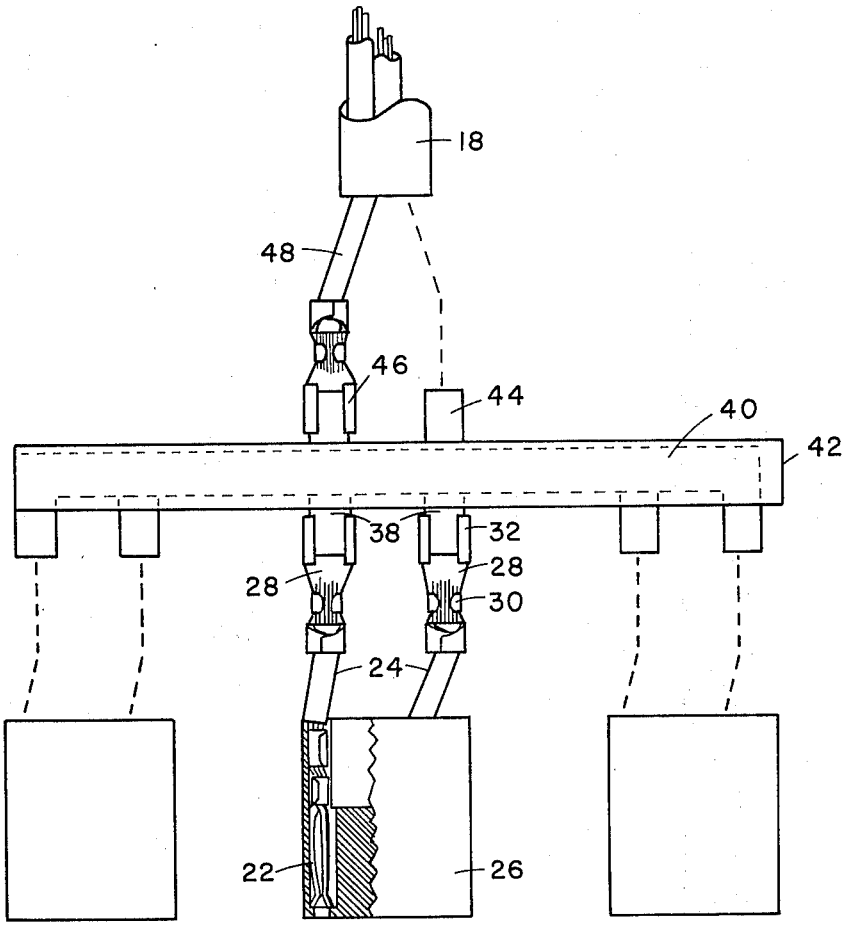
FIG. 2 is a schematic top view of the assembly of receptacles, leads, terminals and connector strips of the present invention.

As shown in FIGS. 1A and 1B, a triple outlet locking connector cordset 10 includes three like three-wire receptacles 12, 14, 16 connected to a common three-wire line 18 which connects to a plug (not shown). The assembly is molded in an integral insulation cover 20 of a suitable material such as polyvinyl chloride. The locking receptacle is preferably of the type described in co-pending U.S. application Ser. No. 563,023, filed Mar. 28, 1975 now U.S. Pat. No. 3,945,708 and assigned to the same assignee as the instant application. FIG. 2 shows a partial cross-section of one receptacle which includes three like curved contacts 22, preferably of brass, and connecting leads 24 held within an inner cylindrical premold structure 26 which may be of nylon. Only one contact and two leads are illustrated. The leads 24 are also connected to three terminals 28 (only two being shown in FIG. 2).

Figure 3:
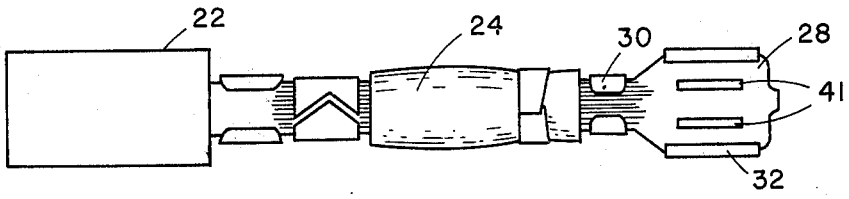
FIG. 3 shows a top view of a contact and terminal assembly.

FIG. 3 shows an enlarged detailed view of a receptacle contact 22 connected to a bare wire end of insulated lead 24. The opposite bare wire end of lead 24 is connected to a slideable detachable terminal 28, preferably of brass, which is shown separately in FIG. 4. Terminal 28 includes a pair of tabs 30 which are compressed around the bare wire of lead 24. Two inwardly curved resilient members 32 having beveled lower edges provide a vertical space 34 between a flat bottom portion 36 and the members 32. The space 34 and flat portion 36 are adapted to slideably receive a flat tab or blade 38 extending from a longitudinal flat connector strip or bus bar 40, shown in FIGS. 2, 5 and 6. Blade 38 is of a sufficient thickness to fit tightly in space 34 so that the resilient members 32 are forced away from flat portion 36 and provide a compressive spring action to hold the tab in position. The blade and terminal are readily connected and detached by hand in a simplified assembly operation. Two longitudinal slots 41 in the flat portion of the terminal are adapted to receive blades having embossments to provide a more positive mechanical connection.

Three like connector strips 40, preferably of brass, are supported within a rectangular premold 42, preferably of polyvinyl chloride. The premold is formed with three vertically spaced longitudinal slots and openings to receive the strips and extending tabs which are inserted into the slots. Each strip 40 has three tabs 38 on one side for engagement with three like terminals 28 connected through three respective leads 26 and contacts 22 of each receptacle 12, 14, 16. For example, each receptacle may have black, white and green leads for two electrical power connections and one ground connection. The three black leads would be connected through terminals 28 to the respective tabs 38 on one side of the upper connector strip, the white leads connected to the tabs on one side of the central strip, and all green leads connected to the tabs on one side of the lower strip. The strips are displaced longitudinally so that the tabs are in line with the associated leads 24 and terminals 28. Since two of the three wires of the terminals on each receptacle in the present figures are in vertical alignment, only one of those two wires is shown in FIG. 2. Two connector strips and tabs are also aligned vertically so that only two tabs for each receptacle are seen in the top view of FIG. 5A. All of the like leads of the respective receptacles are connected in parallel by the three tabs to one strip with only one tab 44 extending from the opposite side. Each strip thus has one tab which connects through like slideable detachable terminals 46 to a respective lead 48 from a three-wire inlet wire cord 18 and a plug which is not shown.

In order to prepare the entire assembly for molding, the various sub-assemblies are completed first. The receptacle premold 26 is assembled with contacts 22 connected to leads 24 and terminals 28, the connector strips 40 are assembled with the premold 42, terminals 46 are connected to leads 48, and the terminals 28 and 46 are then assembled with the blades 38 and 44 of strips 40. The entire assembly is then mounted in a suitable mold for applying the insulation cover 20. The premolds and spring type terminals secure the elements in position with the assembly being held by load plugs and support pins in the mold cavity. This prevents movement during molding and assures good electrical contacts. The molding operation results in the integral water-tight cordset unit shown in FIG. 1.

The above device has been described as utilizing a locking type receptacle having a cylindrical premold. However, a more conventional three-wire receptacle with standard straight contacts may likewise be used. Such a device is used with the same connector strip premold, strips with extending blades, and resilient sliding detachable terminals. The present invention thus provides a novel simplified reliable multiple outlet connector in an integral molded structure. While only a single embodiment has been fully described and illustrated, it is apparent that other variations may be made in the particular design and configuration without departing from the scope of the invention as set forth in the appended claims.

What is claimed is:

1. An electrical connector having a multiple wire electrical supply line interconnected to a plurality of electrical outlets each having the same plurality of wires associated therewith including a plurality of flat conductive strips, each strip having a plurality of connecting tabs extending from one edge thereof for connecting each of said outlet wires thereto and one connecting tab extending from the opposite edge thereof for connecting a corresponding wire of said supply line, insulating means having a plurality of slots therethrough for positioning said strips in a spaced insulated relationship, and terminals on each of said wires connected to said connecting tabs whereby each of the wires of said supply line is connected to one of said connecting tabs extending from said opposite edge of each of said strips and each of said connecting tabs on said one side is connected to a wire associated with each of said outlets.

2. The electrical connector of claim 1, further including an outer common integral molded cover enclosing said supply line, said outlets, said strips and said insulating means.

3. The electrical connector of claim 2, wherein said supply line has two wires interconnected by two of said strips to two, two-wire outlets.

4. The electrical connector of claim 2, wherein said supply line has three wires interconnected by three of said strips to three, three-wire outlets.

* * * * *